US005602758A

United States Patent [19]

Lincoln et al.

[11] Patent Number: 5,602,758

[45] Date of Patent: Feb. 11, 1997

[54] INSTALLATION LINK-UP PROCEDURE

[75] Inventors: Larry A. Lincoln, Milpitas; Robert M. Russ, Los Altos Hills, both of Calif.; William W. Bassett, Wheaton, Ill.; Nir Merry, Albany; Thomas L. Webster, Piedmont, both of Calif.

[73] Assignee: Gas Research Institute, Chicago, Ill.

[21] Appl. No.: 378,514

[22] Filed: Jan. 26, 1995

Related U.S. Application Data

[63] Continuation-in-part of Ser. No. 7,203, Jan. 22, 1993, abandoned.

[51] Int. Cl.[6] ..... F25B 29/00

[52] U.S. Cl. ..... 364/505; 364/557; 236/47; 165/205; 62/126

[58] Field of Search ..... 364/505, 551.01, 364/557, 151, 186, 187; 236/151, 47; 454/256; 356/380; 62/90, 173, 126; 165/12, 22, 14, 15, 13

[56] References Cited

U.S. PATENT DOCUMENTS

| | | | |
|---|---|---|---|
| 4,742,475 | 5/1988 | Kaiser et al. | 364/550 |
| 4,812,997 | 3/1989 | Okochi et al. | 364/505 |
| 4,884,214 | 11/1989 | Parker et al. | 364/505 |
| 4,897,798 | 1/1990 | Cler | 364/505 |
| 5,039,009 | 8/1991 | Baldwin et al. | 236/51 |
| 5,148,977 | 9/1992 | Hibino et al. | 236/49.3 |
| 5,153,807 | 10/1992 | Saito et al. | 364/165 |
| 5,161,606 | 11/1992 | Berkeley et al. | 165/1 |
| 5,172,490 | 12/1992 | Tatsumi et al. | 34/54 |
| 5,348,078 | 9/1994 | Dushane et al. | 165/22 |

*Primary Examiner*—Edward R. Cosimano
*Assistant Examiner*—Kamini S. Shah
*Attorney, Agent, or Firm*—Dick and Harris

[57] ABSTRACT

An apparatus and method for preparing an indoor environmental conditioning system for spaces, for operation. The apparatus and method are advantageously configured for use with an indoor environmental conditioning system in which the spaces are provided with an indoor environmental conditioning input and an indoor environmental conditioning sensor, both operably connected to an indoor environmental conditioning source. Each space is further provided with means for actuating the indoor environmental conditioning source. The apparatus and method enable the indoor environmental conditioning system to be placed in an initial condition such that no space can receive, and no sensor report, indoor environmental conditioning. The indoor environmental conditioning inputs are actuated one at a time, and operably linked thereafter with the indoor environmental conditioning sensor which reports a change in environmental conditioning status.

13 Claims, 2 Drawing Sheets

13
18
44
32
40
27
36
10

43
12
17
45
22
26
31
35
39
20
41
24
42
11
16
37
19
25
30
34
38
33
28
14

INSTALLATION LINK-UP PROCEDURE

This application is a continuation-in-part of U.S. application Ser. No. 08/007,203 filed Jan. 22, 1993 now abandoned.

BACKGROUND OF THE INVENTION

1. The Field of the Invention

The present invention relates to the field of indoor environmental conditioning systems for spaces, such as HVAC systems for residences and commercial spaces. In particular, the present invention relates to such indoor environmental conditioning systems in which each room or other subdivision of the space is provided with its own separate supply of direct indoor environmental conditioning, as well as its own temperature sensor/thermostat.

2. The Prior Art

In indoor environmental conditioning systems for spaces, such as HVAC systems for residences and commercial spaces, each room or other subdivision of space is often provided with its own temperature sensor, which may report temperatures in that room or space, to a master controller linked to and controlling the operations of the furnace/blower/air conditioner unit/etc.

In those indoor environmental conditioning systems which are divided into zones, but running off of a common furnace/heat pump/air conditioner/etc., each room or space may be provided with its own thermostat, instead of merely a temperature sensor. In addition, in systems which, for example, employ forced air circulation, each space may be provided with its own ducting and movable dampers for regulating the flow of air into the space.

One problem which may arise in the installation of such indoor environmental conditioning systems, is that the coordination between the sensor/thermostat, and any dampers or other equipment which are provided on a room-to-room or space-by-space basis, can be difficult to ensure, especially in applications in which the number of separate spaces being conditioned is large, as in a large commercial setting, or in an apartment building. If the right sensor/thermostat is not functionally linked, in the overall system control, with the corresponding supporting equipment (such as dampers, etc.) and identified with the correct space, then not only is the actual operation and efficiency of the indoor environmental conditioning system compromised, leading to possible shutdown or damage to the system, but even such aspects as bookkeeping, occupancy and maintenance issues may be affected.

A typical example of a miscoordination problem would be the simple mixup in connections, at a master controller, often situated at a furnace, of the assignments of sensor inputs and dampers or other outputs to spaces other than those which are appropriate—for example, connecting the sensor lead for Room A into the input at the master controller for the sensor lead from Room B, and vice versa.

There exist, in the prior art, indoor environmental conditioning control systems which have been provided which enable an indoor environmental conditioning system to reconfigure itself, upon detection of an apparent fault or defect in a portion of its operating structure. An example of such a reconfiguring system is found in Baldwin et al., U.S. Pat. No. 5,276,630. For example, if a thermostat fails and proceeds to report clearly inappropriate calls for heating or cooling, then, upon providing the control system with a set of initial parameters, the control system can recognize behavior characteristic of equipment failure, and essentially remove the faulty thermostat readings from its active inputs. Default operating procedures (minimum heating, etc.) are activated, until such time as a return to appropriate operation is detected by the controller or the controller is reset.

However, the control system of the Baldwin et al. reference has no provision for preventing or correcting for, at the outset, such misassignment of connections as previously described. Indeed, such a misassignment, under some circumstances, might not be detected for extended periods of time.

Accordingly, it is desirable to provide an indoor environmental conditioning system which has the capacity to facilitate the double-checking and correction or reconfiguration of its operational set-up, and in particular, the coordination of such items as space or room assignments for sensors, thermostats, and controls for the operation of movable dampers and the like, or even to self-check and correct its set-up, so as to ensure that the electromechanical set-up of the indoor environmental conditioning system, at least upon initial installation, is correct and complete.

SUMMARY OF THE INVENTION

An apparatus and method for preparing an indoor environmental conditioning system for spaces, for operation. The apparatus and method are advantageously configured for use with an indoor environmental conditioning system in which the spaces are provided with an indoor environmental conditioning input and an indoor environmental conditioning sensor, both operably connected to an indoor environmental conditioning source. Each space is further provided with means for actuating the indoor environmental conditioning source. The apparatus and method enable the indoor environmental conditioning system to be placed in an initial condition such that no space can receive, and no sensor report, indoor environmental conditioning. The indoor environmental conditioning inputs are actuated one at a time, and operably linked thereafter with the indoor environmental conditioning sensor which reports a change in environmental conditioning status.

BEST MODE FOR PRACTICING THE INVENTION

Figure 1:
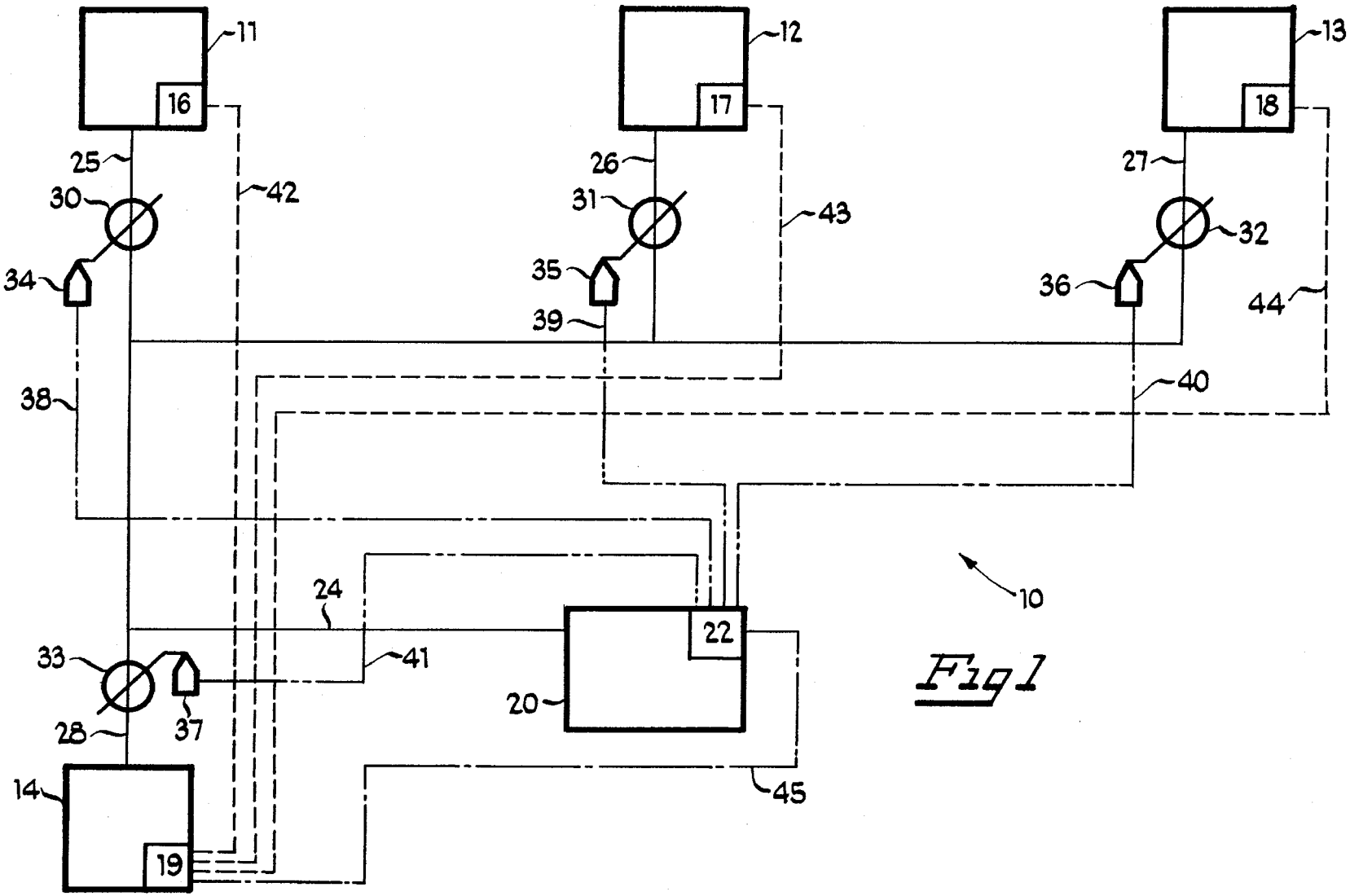
FIG. 1 is a schematic illustration of an indoor environmental conditioning system according to one preferred embodiment of the invention.

While this invention is susceptible of embodiment in many different forms, there is shown in the drawings and will be described in detail herein, two preferred embodiments, with the understanding that the present disclosure is to be considered as an exemplification of the principles of the invention, and is not intended to limit the invention to the embodiments illustrated.

FIG. 1 illustrates a simple indoor environmental conditioning system 10, for spaces 11–14, which are served by indoor environmental conditioning apparatus 20. Environmental conditioning apparatus 20 may be a gas-fired forced-air furnace, a heat pump, a boiler, or an air conditioner. Environmental conditioning apparatus 20 is connected to spaces 11–14 by main thermal transfer conduit 24, which branches into branch conduits 25–28. Conduits 24–28 may be air ducts, water or steam pipes, or any other type of conduit, depending upon the specific nature of indoor environmental conditioning apparatus 20.

Positioned in conduits 25–28, between indoor environmental conditioning apparatus 20, and spaces 11–13, respectively, are flow control apparatus 30–33, respectively. Flow control apparatus 30–33 may be movable air dampers, openable and closable baffles, valves, or the like, depending upon the medium flowing through conduits 25–28. Servocontrollers 34–37 actuate flow control apparatus 30–33, respectively. Each of servocontrollers 34–37 are connected by suitable control transmission lines 38–41, respectively, to master controller 22, connected to indoor environmental conditioning apparatus 20. Master controller 22 may be any suitable programmable (or suitably preprogrammed) control apparatus, such as a microprocessor of known design, and may be provided with an alphanumeric keypad and alphanumeric display, or the like.

In a preferred embodiment of the invention, each of spaces 11–14 may be provided with an apparatus 16–19, respectively, each of which includes a temperature sensor, and each of which may also include a display and/or keyboard input apparatus, (collectively "display sensor") the function of which is described hereinafter. Each of display sensors 16–19 may be connected directly to master controller 22, such that keystrokes entered onto any of the sensors during the set-up or a subsequent procedure may be communicated directly to the master controller 22. Alternatively, one of the display sensors, for example sensor 19, may be a more complex programmable apparatus, such as a fully programmable display thermostat, connected to the other sensors by communication lines 42–44, respectively, and through which all of the sensors may communicate to master controller 22, via communication line 45. In a preferred embodiment of the invention, display sensor 19 may be a fully programmable thermostat, such as are known, which may be utilized to call, in realtime, or preprogram and schedule in advance, heating, cooling or simple ventilation for all spaces in the system, not just its own space 14.

For the purposes of the remainder of the disclosure, indoor environmental conditioning system 10 will be discussed in the embodiment of a forced-air gas furnace system, though of course, the general principles discussed hereinafter will be fully applicable to other types of indoor environmental conditioning system as well.

In practice, the installation of even a simple system, as schematically illustrated in FIG. 1, involves the coordination of many elements. Master controller 22 may be an electromechanical, or more likely, a solid-state, programmable apparatus. Controller 22 will have locations for connecting electrical inputs for receiving input signals from the display sensors. Typically more potential input locations will be provided than will be used in any given application, since such controllers are typically mass-produced devices, and not specially made for specific applications. The programming therein typically derives from a basic general program which is typically individualized to accommodate the specific set of spaces to be environmentally conditioned, during installation. The connections from display sensor input leads to the controller 22 are typically hard-wire connections (although telemetered inputs are contemplated as being within the scope of this invention).

Controller 22 will also have several potential output locations, for connection of leads coming from servocontrollers, such as servos 34–37, so that controller 22 may send actuation signals to the various servocontrollers. As previously stated with respect to the inputs, the connections from the servocontroller leads to the controller 22 outputs are typically hard-wire connections (although telemetered outputs are contemplated as being within the scope of this invention).

If, during the process of making the hardwire connections, the electrician or HVAC technician should happen to cross-connect either the input or output leads corresponding to the display sensors or dampers, for the spaces, to a connection on the master controller 22, allocated or preliminarily assigned or programmed for the other spaces, then, once operations have begun, the master controller may receive confusing or non-enabling instructions, which may lead to unsatisfactory and inefficient operation, and may lead to discomfort of the occupants, and potential damage to or shutdown of the indoor environmental conditioning system.

Once an indoor environmental conditioning system is installed, errors in hardwiring such as described are often difficult to detect and discern the true nature of, and are also often difficult and expensive to correct. In order to alleviate the difficulties which such installation/connection errors can cause, the present invention provides for the post-installation, pre-operational correction of such errors in linkup between the thermostat/sensor space assignments, and damper and servocontroller space assignments, relative to a master controller in an indoor environmental conditioning system.

A post-installation link up procedure, according to a preferred embodiment of the invention, is as follows. Once all wiring connections have been completed, the "identities" of the display sensors in each of the spaces will be made known to the master controller 22, or to master display sensor 19, and in turn, to the master controller 22.

For example, the master controller 22, or display sensor 19 in combination with the master controller 22, may be suitably programmed to have a "naming" mode. The installer will call up the naming mode on the master controller 22 or the display sensor 19, and will enter a designation, such as a selected set of letters or numbers which will be used to refer to the living room, for example. The installer will then physically go to the living room (e.g., room 11), and enter one or more keystrokes on the display sensor 16 in that room, which will send an identifying signal (such as a preselected binary code sequence, etc.) to the master controller 22 or to master display sensor 19, and in turn to master controller 22.

The master controller 22 and/or master display sensor 19 will, upon receiving the identifying signal, permanently correlate the selected reference numbers entered into the master controller 22 or master display sensor 19, with the identifying signal coming from the display sensor 16 in room 11. From then on, the master controller 22 and/or the master display sensor 19 will functionally correspond (link) sensor 16 to room 11.

Each display sensor may be configured so as to always transmit its own unique identifying signal to the master controller 22 and/or master display sensor 19. Alternatively, master controller 22 and/or master display sensor 19 may be suitably programmed so as to always "remember" and "recognize" that a signal which is received through the specific input connections, through which a particular identifying signal were received during the naming mode, correspond to the specific sensor and room which were designated and linked during the naming mode.

The installer will then repeat this sequence for each separate room or space in the system which is desired to be identified and linked to its sensor.

The next major sequence of events is the identification of location for the damper (or other) mechanisms controlling environmental input for each separate room or space. Accordingly, the installer will call up a preprogrammed link-up mode, on the master controller 22 or the master display sensor 19, which mode will be advantageously set up to operate as follows:

The master display sensor 19 and/or the master controller 22 may be preprogrammed or otherwise caused to actuate all servocontrollers so as to close all of them. One servocontroller may then be randomly selected to be opened, and the blower for the furnace 20 is activated. Heating or cooling may or may not also be actuated at this time. The installer then personally observes which space is receiving the moving air (and thus is connected to the open damper). Again assume, for example, that space 11 is receiving the blowing air.

The installer then will press a key or button on display sensor 16. Display sensor 16 will be configured to send a signal to master display sensor 19, or directly to master controller 22. Master controller 22 will identify that sensor 16 in space 11 is communicating. Master controller 22 will then link sensor 16 and space 11 to the damper which has been actuated to permit blowing air, that is, the damper 30 which leads to space 11 and sensor 16. From this point forward, damper 30 will be functionally linked-up with display sensor 16 and space 11, notwithstanding whatever nominal location assignments for the sensors and dampers had been previously or preliminarily assigned, and regardless of whether the original physical connections between the sensors, dampers, and master controller were correct. So long as sensors were not connected to damper connections, etc., the system will be capable of reconfiguring its internal correlations between the components.

In an alternative embodiment of the link-up method, the display sensors may be configured to sense air motion, change in air pressure, sound, light, etc., in addition to temperature change, so as to self-detect or indicate which space is receiving moving or thermally conditioned air. The display sensor sensing the moving or thermally conditioned air may then spontaneously signal the master display sensor, or the master controller directly.

The master controller 22 and master display sensor 19 may then be configured to provide an indication, such as a visual or audible indication, which will indicate that the master controller 22 has received the signals and "mapped" the functional link-up between damper 30, display sensor 16 and space 11. The installer may then cause the damper 30 to be closed and the damper in another space to be opened, to repeat the procedure until all desired spaces have been mapped.

Alternatively, when the master controller has received a signal and "mapped" the pairing of the specific display sensor and the selected damper into its memory, it may automatically send a signal to damper 30 to close that damper, and select another to be opened. The previously described procedure will be repeated until all dampers to be mapped have been mapped into the master controller's memory with corresponding display sensors. The information recorded during the procedure will override any preprogramming to correct for any inadvertent hardwire cross-connections which the installer may have caused.

As previously stated, in one embodiment, display sensors 16–19 might comprise merely keyboard inputs and digital displays with temperature sensors therein, and not thermostats which can independently call for heating or cooling. Alternatively, display sensor 19, however, could be a fully programmable thermostat, as are known. In an alternative embodiment of the invention, each display sensor is also a thermostat, so that, for example, occupants in a given space may override preprogrammed heating, cooling or simple ventilation scheduling which had been performed at master display sensor 19 or at master controller 22.

Figure 2:
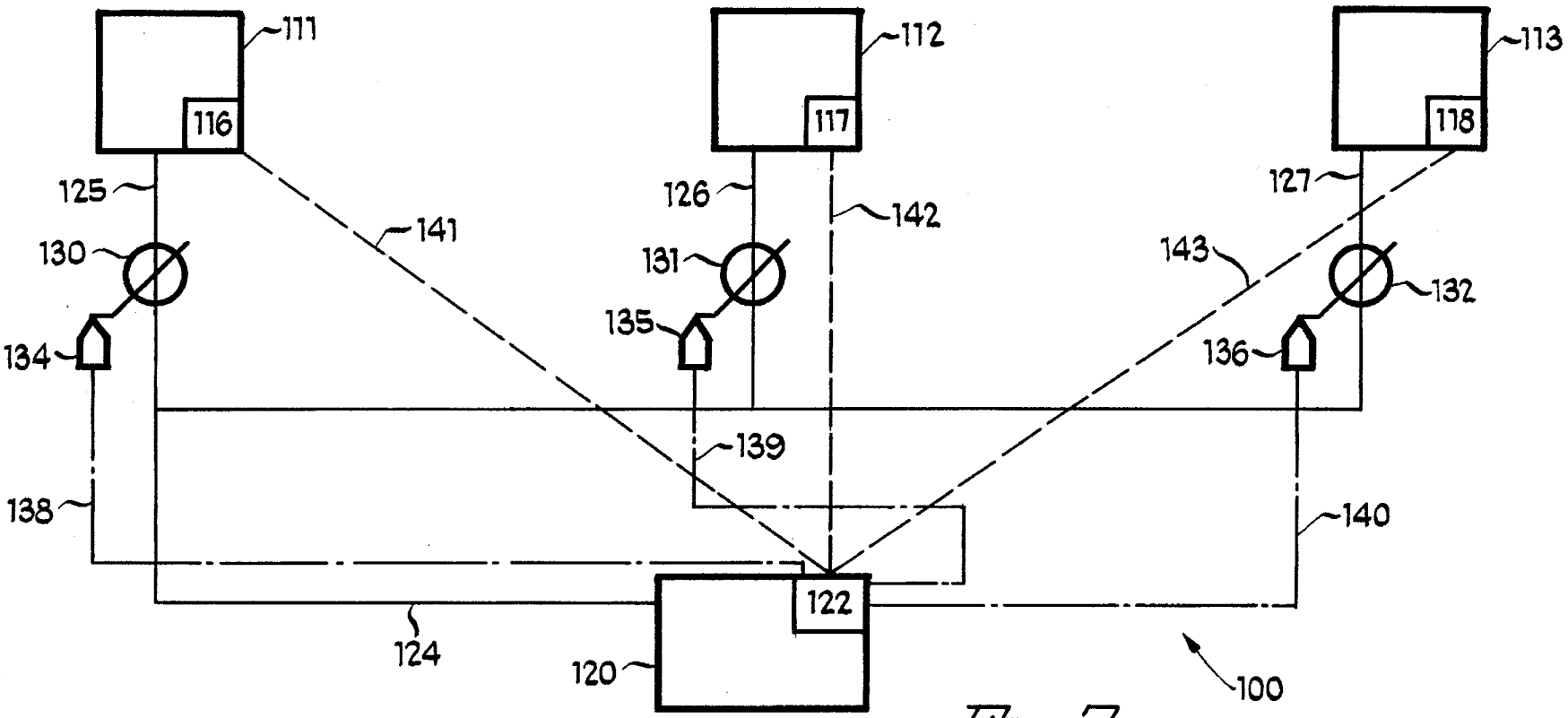
FIG. 2 is a schematic illustration of an indoor environmental conditioning system and control system therefor, according to another preferred embodiment of the invention.

As an alternative embodiment of the invention, a more self-actuating version of the link up procedure and apparatus may be provided. This further embodiment may be employed with a physical set-up, such as illustrated in FIG. 1, or may be used with an even simpler indoor environmental conditioning system, as is schematically illustrated in FIG. 2. In the following discussion relative to the system as illustrated with regard to FIG. 2, elements or steps which are substantially similar to those previously described in relation to the embodiments of FIG. 1, are provided with like reference numerals.

FIG. 2 illustrates a simple indoor environmental conditioning system 100, for three spaces 111, 112 and 113, which are served by indoor environmental conditioning apparatus 120. Thermal conditioning apparatus 120 is connected to spaces 111–113 by main thermal transfer conduit 124, which branches into branch conduits 125, 126 and 127.

Positioned in conduits 125–127, between indoor environmental conditioning apparatus 120, and spaces 111–113, respectively, are flow control apparatus 130–132, respectively. Servocontrollers 134–136 actuate flow control apparatus 130–132, respectively. Each of servocontrollers 134–136 are connected by suitable control transmission lines 138–140, respectively, to master controller 122, connected to indoor environmental conditioning apparatus 120. Master controller 122 may be any suitable programmable (or suitably preprogrammed) control apparatus, such as a microprocessor of known design.

Each of spaces 111–113 is provided with its own thermostat 116–118, respectively, so that indoor environmental conditioning may be supplied, individually, to each of spaces 111–113. Each thermostat 116–118 is connected by a suitable communication line 141–143, respectively, to master controller 122.

For the purposes of the remainder of the disclosure, indoor environmental conditioning system 100 will be discussed in the embodiment of a forced air gas furnace system, though of course, the general principles discussed hereinafter will be fully applicable to other types of indoor environmental conditioning system, as previously stated.

As previously stated, inadvertent cross-connection of the thermostats and/or dampers for the several spaces, at the master controller may create confusion for the master controller, if the controller is forced to rely upon preset location assignments for the elements. For example, an occupant in space 111 sets the thermostat so as to call for heat. If the lead for that space 111 has been connected to the assigned input location on controller 122, for space 112, then heat may be supplied to space 112, against the desire of the occupant of that space (presuming that the connections for flow control apparatus 131 and servocontroller 135 are correct).

In this alternative preferred embodiment of the invention, master controller 122 will be suitably configured, in a known conventional manner and suitably programmed, so as to be able to internally re-direct or reroute input data signals and output command signals. This ability to redirect internally such information, enables the initial hardwire connections and preliminary programming and location assignments with which the master controller 122 was originally provided, to be overridden. Master controller 122 will further be provided, with a diagnostic program will be able to detect incorrect hardwiring prior to instituting full-time operations, and will internally redirect such incorrectly directed signals.

The diagnostic program with which master controller 122 of system 100 will be provided will operate in the following manner. Upon initial start-up, controller 122 will initially command that all flow control apparatus 130–132 will be closed. The readings from all sensors/thermostats 116–118 are recorded, and correlated to their presumed respective spaces. Controller 122 will then arbitrarily select the spaces, open the flow control apparatus which controller 122 perceives or has recorded in its memory as being assigned to that arbitrarily selected space, and activate indoor environmental conditioning apparatus 120, to supply heat or cooling to that selected space.

After a predetermined interval of time, sensors 116–118 are polled, to determined if a temperature change is recorded by controller 122. The interval of time will be selected based upon the characteristics of the indoor environmental conditioning apparatus, the average sizes of the spaces, etc., such that a meaningful temperature change will occur in any of the spaces, if supplied with heating or cooling for that period of time. If the sensor which is assigned to the selected space reports a temperature indicating a temperature change commensurate with the time interval, the characteristics of the selected space and the heating and cooling supplied, then the respective preliminary space assignments of the sensor/thermostat and the flow control apparatus/servocontroller are presumed confirmed and correctly installed.

If, however, the space for which a temperature change is detected is not the space which the controller 22 recognizes as the properly assigned space, then the information is recorded. The controller 22 will from that point on correlate the sensor reporting a temperature change with the flow control apparatus which was activated. At this point it must be recognized that either the initial sensor location assignment is incorrect or the initial flow control apparatus location assignment is incorrect.

The procedure is repeated until each temperature sensor/thermostat is caused to report a temperature change. Each time a temperature change is reported and the reporting sensor is recorded, the flow control apparatus which was actuated to produce the temperature change is recorded and permanently associated in the controller's memory with that specific sensor. In this way, when an occupant of a specific space operates the sensor in that space, the controller will associate that sensor with the flow control apparatus which was "learned", even if not the flow control apparatus which was nominally associated with that sensor, immediately at installation, and "know" which flow control apparatus to actuate to satisfy the sensor/thermostat calling for indoor environmental conditioning.

The foregoing description and drawings merely serve to illustrate the invention and the invention is not limited thereto except insofar as the appended claims are so limited, as those skilled in the art who have the disclosure before them will be able to make modifications and variations therein without departing from the scope of the invention.

We claim:

1. A method for establishing the link-up of components in an indoor environmental conditioning system for spaces, the method comprising:

a. providing each space with a separately controllable indoor environmental conditioning input;

b. connecting each indoor environmental conditioning input to an indoor environmental conditioning source;

c. connecting a control apparatus to the indoor environmental conditioning source;

d. providing each space with an environmental status sensor;

e. operably connecting the control apparatus with each of the sensors;

f. communicating the identity of each of the sensors, one at a time, to the control apparatus;

g. assigning, in succession, a separate designation to each of the sensors;

i. communicating each separate designation to the control apparatus;

j. placing the indoor environmental conditioning system into an initial inactive condition;

k. actuating at least one of the indoor environmental conditioning inputs;

l. actuating the indoor environmental conditioning source;

m. monitoring the spaces to determine which of the spaces receives indoor environmental conditioning;

n. operably linking the indoor environmental conditioning sensor, in the space which received conditioning, with the respective means for actuating at least one of the respective indoor environmental conditioning inputs, which were actuated to cause environmental conditioning in the specific space; and o. repeating steps j. through n. until a desired number of the indoor environmental conditioning sensors and respective ones of the indoor environmental conditioning inputs are operably linked.

2. The method according to claim 1, further comprising the steps of:

p. connecting each of the sensors and the control apparatus to an intermediate control apparatus, so as to enable the performance of steps f. through o. through the intermediate control apparatus.

3. The method according to claim 1, wherein each of the indoor environmental conditioning inputs comprise a remotely controllable damper for an air duct.

4. The method according to claim 3, wherein at least the indoor environmental conditioning source comprises a gas-fired furnace with circulating air blower.

5. The method according to claim 1, wherein the separate indoor environmental conditioning control sensor further comprises a thermostat.

6. An apparatus for preparing an indoor environmental conditioning system for a plurality of separate spaces for operation, said indoor environmental conditioning system including an indoor environmental conditioning source, an indoor environmental conditioning sensor operably disposed in each space, means for actuating the indoor environmental conditioning source disposed in each space and operably connected to the indoor environmental conditioning source, and an indoor environmental conditioning input disposed in each space and operably connected to the indoor environmental conditioning source, said apparatus comprising:

means for placing the indoor environmental conditioning system into an initial condition by causing each means for actuating a respective indoor environmental conditioning input to be in a non-actuating condition;

means for selecting the means for actuating a respective indoor environmental conditioning input;

means for causing the selected means for actuating a respective indoor environmental conditioning input to be in an actuating condition;

means for actuating the indoor environmental conditioning source;

means for monitoring the spaces to determine which of the spaces receives indoor environmental conditioning; and means for operably linking the indoor environmental conditioning sensor, in the space which received conditioning, with the respective means for actuating a respective indoor environmental conditioning input, which was actuated to cause conditioning in the specific space.

7. The apparatus according to claim 6, further comprising:

means for returning the indoor environmental conditioning system into the initial condition, after connection of the first indoor environmental conditioning sensor;

means for selecting another of the means for actuating a respective indoor environmental conditioning input;

means for causing said another selected one of the means for actuating a respective indoor environmental conditioning input to be in an actuating condition;

means for actuating the indoor environmental conditioning source;

means for monitoring the spaces to determine which of the remaining spaces receives indoor environmental conditioning;

means for operably linking the indoor environmental conditioning sensor, in the space which received conditioning, with the selected another respective means for actuating a respective indoor environmental conditioning input, which was actuated to cause conditioning in the specific space; and means for repeating the foregoing steps until all means for actuating a respective indoor environmental conditioning input have been operably linked to an indoor environmental conditioning sensor.

8. The apparatus according to claim 6, wherein the indoor environmental conditioning input comprises a remotely controllable damper for an air duct.

9. The apparatus according to claim 6, wherein the indoor environmental conditioning source comprises a gas-fired furnace with circulating air blower.

10. The apparatus according to claim 6, wherein the indoor environmental conditioning source comprises an air conditioner unit.

11. The apparatus according to claim 6, wherein the separate indoor environmental conditioning control sensor and means for actuating the indoor environmental conditioning source together comprise a thermostat.

12. An apparatus for preparing an indoor environmental conditioning system for a plurality of separate spaces for operation, said indoor environmental conditioning system including an indoor environmental conditioning source, an indoor environmental conditioning sensor disposed in each space, means for actuating the indoor environmental conditioning source disposed in each space and operably connected to the indoor environmental conditioning source, and an indoor environmental conditioning input disposed in each space and operably connected to the indoor environmental conditioning source, said apparatus comprising:

means for causing each means for actuating a respective indoor environmental conditioning input to be in a non-actuating condition and placing the indoor environmental conditioning system into an initial condition;

means for monitoring each of the indoor environmental conditioning control sensors;

means for recording each of the indications of environmental status provided by each of the indoor environmental conditioning control sensors;

means for selecting the means for actuating a respective indoor environmental conditioning input;

means for causing the selected one of the means for actuating a respective indoor environmental conditioning input to be in an actuating condition;

means for monitoring the indications provided by the indoor environmental conditioning control sensors;

means for identifying whether any of the indoor environmental conditioning sensors indicates a change in environmental status; and means for operably linking any indoor environmental conditioning sensor which indicates a change in environmental status with the respective means for actuating a respective indoor environmental conditioning input, which was actuated to cause the indication of change in environmental status.

13. The apparatus according to claim 12, further comprising:

means for returning the indoor environmental conditioning system into an initial condition, after linking the first indoor environmental conditioning sensor indicating a change in environmental status with the respective means for actuating a respective environmental input, by causing each means for actuating a respective indoor environmental conditioning input to be in a non-actuating condition;

means for monitoring each of the indoor environmental conditioning control sensors;

means for recording each of the indications of environmental status provided by each of the indoor environmental conditioning control sensors;

means for selecting another of the means for actuating a respective indoor environmental conditioning input;

means for causing said selected another of the means for actuating a respective indoor environmental conditioning input to be in an actuating condition;

means for monitoring the indications provided by the indoor environmental conditioning control sensors;

means for identifying whether any of the indoor environmental conditioning sensors indicates a change in environmental status; and means for operably linking any indoor environmental conditioning sensor which indicates a change in environmental status with the respective means for actuating a respective indoor environmental conditioning input, which was actuated to cause the indication of change in environmental status; and means for repeating the foregoing steps until all means for actuating a respective indoor environmental conditioning input have been selected.

* * * * *